US007473674B1

(12) United States Patent
Thompson

(10) Patent No.: US 7,473,674 B1
(45) Date of Patent: Jan. 6, 2009

(54) BIODEGRADABLE CLEANER

(76) Inventor: John A. Thompson, 231 S. 79th St., Milwaukee, WI (US) 53214

( * ) Notice: Subject to any disclaimer, the term of this patent is extended or adjusted under 35 U.S.C. 154(b) by 498 days.

(21) Appl. No.: 11/070,111

(22) Filed: Mar. 2, 2005

Related U.S. Application Data

(60) Provisional application No. 60/558,292, filed on Mar. 31, 2004.

(51) Int. Cl.
*C11D 7/50* (2006.01)

(52) U.S. Cl. ..... 510/365; 510/407

(58) Field of Classification Search ..... 510/365, 510/407
See application file for complete search history.

(56) References Cited

U.S. PATENT DOCUMENTS

| | | | | |
|---|---|---|---|---|
| 862,305 | A | | 8/1907 | Braun |
| 1,719,933 | A | | 7/1929 | Huff |
| 5,340,495 | A | | 8/1994 | Mulcahy et al. |
| 5,763,379 | A | * | 6/1998 | Janota ..... 510/245 |
| 5,814,163 | A | | 9/1998 | Wojcik |
| 5,935,918 | A | | 8/1999 | Pomp |
| 6,077,817 | A | | 6/2000 | Pomp |
| 6,191,087 | B1 | | 2/2001 | Opre et al. |
| 6,284,720 | B1 | | 9/2001 | Opre |
| 6,620,772 | B2 | | 9/2003 | Garmier |

* cited by examiner

*Primary Examiner*—Gregory E Webb
(74) *Attorney, Agent, or Firm*—Boyle Fredrickson SC

(57) ABSTRACT

The present invention is a cleaning composition for use with firearms and industrial items in which all of the components of the composition are biodegradable. The selected components of the composition also have a combined flashpoint of over 200° F. The low volatility of the composition enhances the safety factor by its reduced flammability in conjunction with the low odor and other benefits obtained by the biodegradability of the composition. The composition essentially comprises a hydrocarbon solvent and a lubricant which effectively removes the fouling present within the interior arm of a firearm bore and at the same time lubricates and protects the firearm bore to help prevent the formation of rust.

10 Claims, No Drawings

BIODEGRADABLE CLEANER

CROSS-REFERENCE TO RELATED APPLICATIONS

The application claims priority from U.S. Provisional Patent Application Ser. No. 60/558,292, filed on Mar. 31, 2004, the entirety of which is incorporated by reference.

FIELD OF THE INVENTION

The present invention relates to cleaners, and more specifically to cleaners utilized as industrial degreasers for use with various items, such as firearms.

BACKGROUND OF THE INVENTION

Due to the various chemicals utilized in propelling a projectile out of a firearm, the barrel of the firearm becomes fouled with residual chemicals which build up after the firing of each projectile. In order to keep the firearm functioning properly, and to ensure that the projectiles coming out of the firearm are not affected by any build up of fouling on the interior of the firearm bore, the bore must be cleaned on a regular basis.

A number of different cleaning solvents have been developed for use in removing fouling from the interior of gun bores. These solvents and formulations normally include volatile components or solvents in order to more effectively remove the fouling present within the barrel of the firearm. Further, the harshness of the solvents, in conjunction with the tools used with these solvents, can easily damage the interior surface of the bore, which is highly undesirable. However, the majority of these solvents are formed utilizing components which are highly volatile, requiring that extreme care be taken when cleaning the firearm bore. As a result, these solvents and cleaning compositions are very often harmful to the individual using the solvent. Also, the components of the solvent are harmful to the environment if disposed of in an improper manner, requiring that the solvent be disposed of in a manner requiring much time, expense and effort, which significantly increase the overall cost of utilizing these solvents. Further, the harshness of the solvents, in conjunction with the tools used with these solvents, can easily damage the interior surface of the bore, which is highly undesirable. Therefore, a number of cleaning compositions have been developed in which the compositions themselves are designed to be non-volatile to reduce or eliminate the harmful effects of the compositions. For example, Mulcahy et al. U.S. Pat. No. 5,340,495 discloses a composition for cleaning ink that incorporates a methyl ester of a fatty acid, and a nonionic surfactant that is an ethoxylated alcohol. Another example is shown in Wojcik U.S. Pat. No. 5,814,163 disclosing a cleaning composition having at least one monoester, at least one methyl ester, at least one linear olefinic hydrocarbon and 2,2,4-trimethyl-1,3-pentandiol mono (2-methyl propanoate). Further examples of environmentally friendly cleaning compositions are disclosed in Opre U.S. Pat. No. 6,282,720 (disclosing a composition including an ester of lactic acid, an ester of a fatty acid, an organic co-solvent and a surfactant) and Garmier U.S. Pat. No. 6,620,772 (disclosing a biodegradable lubricant having a triglyceride oil, an organic solvent, an antioxidant and a corrosion inhibitor).

Most of these environmentally friendly cleaning solutions are designed for cleaning materials such as printing ink, and not for the more resistant fouling found within a firearm bore. However, some reduced volatility and environmentally friendly firearm cleaning solutions of this type have been developed and are disclosed in Pomp U.S. Pat. Nos. 5,935,918 and 6,077,817. In the firearm cleaning solutions disclosed in these patents, a biodegradable, reduced volatility hydrocarbon solvent is utilized, which is preferably a butyl lactate. The solvent is utilized in conjunction with a hydrocarbon citrus distillate in order to effectively remove fouling from within a firearm bore, including various metal residues. The solvent effectively removes the metal residue from within the bore, while the citrus distillate preventing the readherence of the fouling to the metal of the bore of the firearm.

While these more "friendly" firearm cleaning compositions do not have the safety concerns that earlier compositions had, these newer compositions have a reduced effectiveness in cleaning the metal residue in a firearm bore. The metal residue in the bore is the most difficult portion of the fouling residue to remove from the firearm. This metal residue may include layers of lead or lead alloy from firing lead, or partially-jacketed bullets, and/or copper, gliding metal or other cover alloy metals from jacketed bullets. The copper and copper alloy residues poise a particularly difficult cleaning problem due to the relatively strong electric positive nature of copper.

As a result, it is desirable to develop a cleaning solvent composition for use with firearms and other similar types of items which is formulated utilizing components which are biodegradable and much less volatile than the components utilized in prior art cleaning compositions that can remove all components of the fouling present in a firearm bore, including metal residues. In addition to the low volatility, the solvent should also have a high flashpoint which results in a product which has reduced flammability and a low odor.

SUMMARY OF THE INVENTION

According to a primary aspect of the present invention, a cleaning composition is provided in which each of the components of the composition is biodegradable, eliminating the need for the extensive disposal procedures required when discarding prior art cleaning compositions. The cleaning composition, though biodegradable, has the ability to remove various deposits from items, including the fouling and metal residues present in a firearm bore. The ability to dispose of the cleaning composition in a manner which does not require special handling greatly reduces the overall cost of utilizing the composition.

According to another object of the present invention, the composition also only includes components which have a high flash point, thereby greatly reducing the flammability or volatility of the composition. By utilizing only these types of components, the composition does not require complex and expensive handling procedures, as the composition will not combust under the same conditions at which prior art cleaning compositions would be made.

According to still another aspect of the present invention, the cleaning composition includes only a small number of components, thereby reducing the time and cost necessary to formulate the cleaning composition.

Other aspects, features and advantages of the present invention will be made apparent from the following detailed description.

DETAILED DESCRIPTION OF THE INVENTION

The present invention is a cleaning composition or formulation which contains only low volatility and biodegradable components. The formulation of a composition with these components allows the composition to be more conveniently and easily stored prior to use, more easily handled during use, and more conveniently and easily disposed of after use.

The cleaning composition includes two essential components, namely: 1) a hydrocarbon solvent; and 2) a lubricant. These two components can be used alone to form the cleaning composition, or can be formulated with additional components as desired.

The hydrocarbon solvent can be a solvent formed from any suitable non-volatile hydrocarbon or mixed hydrocarbons, and is preferably formed from mixed unsaturated hydrocarbons, such as mixed olefins. The hydrocarbons suitable for use as the solvent in the cleaning composition of the present invention preferably have a flash point of above at least 100° F., and more preferably above 150° F., and are biodegradable. The olefins that are particularly preferred for use as the hydrocarbon solvent mixture include mixtures of olefins selected from the group comprising alpha olefin constituents having the general structural formula:

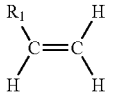

wherein $R_1$ is an alkyl group having between 4 to 28 carbon atoms. Preferably $R_1$ of the olefin is an alkyl group having between 10 to 26 carbon atoms. It has been found that superior results are produced by compositions including alpha olefins having between 14 and 28 carbon atoms. Accordingly, it is most highly preferred that the olefin is selected from the group consisting of 1-hexadecene, 1-octadecene, 1-eicocene, 1-doeicocene, 1-tetraeicocene, 1-hexaeicocene, 1-octacicocene, 1-tetradecene, 1 pentadecene and mixtures thereof.

The hydrocarbon solvent utilized in the composition works on all of the components of the fouling present in a firearm bore to loosen the fouling from the bore such that the fouling can be carried by the composition out of the bore. This includes any metal residue adhering to the bore from the cartridge and/or projectiles fired through the bore. Further, due to the low volatility of the hydrocarbon solvent, the solvent evaporates slowly, allowing the solvent to actively work on the fouling present within the bore, such as lead, gunpowder and copper fouling, for an extended period of time in order to more effectively and completely remove the fouling from the bore.

The lubricant or oil component of the composition functions to assist the hydrocarbon solvent in removing the fouling and also enables the composition to be self-lubricating. Thus, the composition provides the benefit of providing adequate lubrication to the bore of the firearm for continued use of the firearm without requiring a separate gun oil or other similar lubricating composition to be utilized on the bore after it has been cleaned using the cleaning composition of the present invention. The lubricant component of the cleaning composition is preferably a fatty acid ester of methyl, ethyl, propyl or butyl alcohol. More preferably, the lubricant is selected from the group including methyl lardate, methyl oleate, butyl oleate, butyl stearate, and methyl soyate, with methyl soyate being especially preferred.

The cleaning composition of the present invention can be formulated to include between 25% and 95% by weight of the formulation of the hydrocarbon solvent and between 5% and 35% by weight of the formulation of the lubricant. More preferably, the solvent is present in amounts closer to the upper and lower ends of each range such that a pair of preferred embodiments of the cleaning composition are formed with approximately 70% by weight of the solvent and 30% by weight of the lubricant, and also 90% by weight of the solvent and 10% by weight of the lubricant.

The cleaning composition of the present invention formed from the hydrocarbon solvent and the oil also has a combined flash point of over 150° F. and preferably over 200° F. At either of these levels, the composition is essentially non-flammable in virtually all possible conditions where the cleaning composition is to be used. Also, because of the low vapor pressure of the hydrocarbon solvent, as discussed previously, the solvent does not readily evaporate. Therefore, the composition does not have as strong an odor similarly to other prior art cleaning compositions which use different and/or more volatile solvents.

In order to formulate the cleaning composition, initially the hydrocarbon solvent in the proper amount for the desired formulation is placed within a solvent-resistant mixer or mixing container, preferably formed from stainless steel which will not react with the solvent. The solvent is then continuously stirred within the container and the selected amount of the lubricant is added to the continuously agitated solvent within the container. The mixture of the solvent and the lubricant is continuously agitated within the container for at least three (3), and preferably twenty (20) minutes, or until the lubricant is thoroughly and homogenously mixed throughout the solvent.

In order to use the cleaning composition to clean a firearm bore, in one preferred method a suitable patch or cloth is saturated with the cleaning composition. The cloth is then pushed through the firearm bore from the breach to the muzzle and out of the bore. As the cloth is moved through the bore, the cleaning composition on the cloth contacts, interacts with and removes the fouling from the interior surface of the bore and leaves behind a thin film of the composition. If after the cloth has been moved through the bore all the fouling previously present in the bore has been removed, a second cloth saturated with the composition can be pushed through the bore to leave a thin film of the composition on the interior surface of the bore to lubricate the bore. The thin film of the composition remaining in the bore also helps prevents rust from forming on the interior of the bore as the metal forming the bore has reduced contact with the surrounding air, thereby limiting any oxidation of the metallic bore with the oxygen in the air. However, if any fouling remains on the interior of the bore after the first cloth is moved through the bore, additional cloths saturated with the cleaning composition are subsequently pushed through the bore, optionally in conjunction with the use of a bristle bush, until all of the fouling is removed. At that time, the extra cloth is then pushed through the bore to leave the thin film of the composition on the interior surface of the bore for the reasons described previously. However, due to the efficiency of the cleaning composition in removing all of the components of the fouling within the bore, the brush is not required, greatly lessening the chance of damaging the interior of the bore.

Other optional ingredients which have significant benefits when utilized with the composition of the present invention include certain antioxidants and rust preventatives in addition to or anti-corrosion agents. The antioxidants and anti-corrosion agents suitable for use in this composition necessarily need to be biodegradable, have a low odor, and not detrimental to the ability of the cleaning composition to remove the fouling on the gun. The antioxidants suitable for use in the cleaning composition include tocopherols, lecithin compounds, butylated hydroxytoluene (BHT), butylated hydroxyanisole (BHA), dilauryl thiodipropinate, and other esters of thiodipopinate. The suitable anti-corrosion agents include compounds from the oxazolidone family, compounds from the imadolizone family, alkanolamide and its derivatives, sorbitan esters, sarcosine esters and various proprietary anti-corrosion agents sold by Alox Corp. of Niagara Falls, N.Y. The amounts of each of these additional ingredients can vary depending upon the particular application for which the cleaning composition is being used, but the antioxidants are normally present in the range of less than 3% by weight and preferably less than 1% by weight of the composition. For the anti-corrosion agents, the amount incorporated into the cleaning composition can be up to 65% by weight of the composition, with a more preferred amount being up to 25% by weight of the composition, and a most preferred amount of less than 5% by weight. Other ingredients are also contemplated as being added to the solvent composition depending upon the particular use for the composition.

Various alternatives are contemplated as being within the scope of the following claims particularly pointing out and distinctively claiming the subject matter regarded as the invention.

I hereby claim:

1. A cleaning composition consisting of:

a) a hydrocarbon solvent selected from the group consisting of: 1-hexadecene, 1-octadecene, 1-eicocene, 1-doeicocene, 1-tetraeicocene, 1-hexaeicocene, 1-octaeicocene, 1-tetradecene, 1 pentadecene and mixtures thereof; and b) a lubricant selected from the group consisting of: a fatty acid ester of methyl, ethyl, propyl and butyl alcohol.

2. The composition of claim 1 wherein the solvent is present in an amount of between 25% and 95% by weight of the composition.

3. The composition of claim 1 wherein the lubricant is present in an amount of between 5% and 35% by weight of the composition.

4. The composition of claim 1 wherein the solvent is present in an amount of 90% by weight of the composition, and the lubricant is present in the amount of 10% by weight of the composition.

5. The composition of claim 1 wherein the solvent is present in an amount of about 70% by weight of the composition, and the lubricant is present in an amount of about 30% by weight of the composition.

6. The composition of claim 1 wherein the hydrocarbon solvent is selected from the group consisting of 1-hexadecene and 1-tetradecene.

7. The composition of claim 1 wherein the lubricant is a fatty acid of a methyl ester.

8. The composition of claim 7 wherein the lubricant is methyl soyate.

9. A cleaning composition consisting essentially of:

a) a hydrocarbon solvent selected from the group consisting of: 1-hexadecene, 1-octadecene, 1-eicocene, 1-doeicocene, 1-tetraeicocene, 1-hexaeicocene, 1-octaeicocene, 1-tetradecene, 1 pentadecene and mixtures thereof; and b) a lubricant selected from the group consisting of: a fatty acid ester of methyl, ethyl, propyl and butyl alcohol, wherein the cleaning composition includes an antioxidant in an amount of less than 3% by weight of the composition, and the antioxidant is selected from the group consisting of tocopherol compounds, lecithin compounds, butylated hydroxytoluene, butylated hydroxyanisole, dilaurly thiodipropanoate, and other thiodipropanoate esters.

10. A cleaning composition consisting essentially of:

a) a hydrocarbon solvent selected from the group consisting of: 1-hexadecene, 1-octadecene, 1-eicocene, 1-doeicocene, 1-tetraeicocene, 1-hexaeicocene, 1-octaeicocene, 1-tetradecene, 1 pentadecene and mixtures thereof; and b) a lubricant selected from the group consisting of: a fatty acid ester of methyl, ethyl, propyl and butyl alcohol, wherein the cleaning composition includes an anti-corrosion agent in an amount of up to 65% by weight of the composition, and the anti-corrosion agent is selected from the a group consisting of compounds of the oxazolidone family, compounds of the imadolizone family, alkanolamide and its derivatives, sorbitan esters and sarcosine esters.

* * * * *